US007950841B2

(12) United States Patent
Klein et al.

(10) Patent No.: US 7,950,841 B2
(45) Date of Patent: May 31, 2011

(54) CONCRETE COOLING INJECTION UNIT AND METHOD OF INJECTING A COOLANT INTO A CONCRETE MIXTURE

(75) Inventors: Eric P. Klein, Houston, TX (US); Dino K. Teas, Houston, TX (US); Andrew M. Garnett, Houston, TX (US)

(73) Assignee: Air Liquide Industrial U.S. LP, Houston, TX (US)

( * ) Notice: Subject to any disclaimer, the term of this patent is extended or adjusted under 35 U.S.C. 154(b) by 708 days.

(21) Appl. No.: 11/339,840

(22) Filed: Jan. 25, 2006

(65) Prior Publication Data

US 2007/0171764 A1 Jul. 26, 2007

Related U.S. Application Data

(60) Provisional application No. 60/655,975, filed on Feb. 23, 2005.

(51) Int. Cl.
*B28C 5/46* (2006.01)

(52) U.S. Cl. ..... 366/4

(58) Field of Classification Search ..... 366/7, 10, 366/11; 239/128; 62/600, 615, 62, 64, 74, 62/259.1, 239; 427/215, 398.1
See application file for complete search history.

(56) References Cited

U.S. PATENT DOCUMENTS

| | | | | |
|---|---|---|---|---|
| 6,318,193 | B1 * | 11/2001 | Brock et al. | 73/864.74 |
| 2009/0103392 | A1 * | 4/2009 | Bilger | 366/4 |

FOREIGN PATENT DOCUMENTS

| | | | |
|---|---|---|---|
| EP | 01120304 | | 5/1989 |
| EP | 06270128 | | 9/1994 |
| GB | 2106887 | A | 7/1982 |
| JP | 61229506 | | 5/1985 |
| JP | 62150110 | * | 9/1987 |
| WO | 03061925 | A1 | 7/2003 |

OTHER PUBLICATIONS

Translation of JP 62150110 U document as published on 19870922, The Mcelroy Translation Company, 14 pages, Nov. 2009.*
Coolcrete Drive Thru Unit, Model 2700B, Instructions for Installation and Operation, Airco Industrial Gases, 152 pages.
PCT International Search Report, Sep. 5, 2006, 4 pgs.

* cited by examiner

*Primary Examiner* — Tony G Soohoo

(57) ABSTRACT

A method and apparatus for cooling a mixture with an injection system. The injection system is adjustable to accommodate the relative position and particular specifications of a given container (e.g., concrete mixer). In one embodiment, the injection system is operable to inject a coolant directly into the mixture while in the mixing process.

14 Claims, 13 Drawing Sheets

CONCRETE COOLING INJECTION UNIT AND METHOD OF INJECTING A COOLANT INTO A CONCRETE MIXTURE

CROSS-REFERENCE TO RELATED APPLICATIONS

This application claims the benefit under 35 U.S.C. §119 (e) to provisional application Ser. No. 60/655,975, filed Feb. 23, 2005, the entire contents of which are incorporated herein by reference.

BACKGROUND

1. Field of the Invention

Embodiments of the present invention generally relate to an apparatus and method for cooling concrete. Particularly, the present invention relates to an apparatus and method for injecting a cryogenic liquid.

2. Description of the Related Art

In concrete preparation it is often necessary to cool the concrete mix. The structural integrity of concrete is dependent on the temperature at which the concrete is set. In general, the cooler the concrete when poured, the stronger it will be once set. If poured at high temperatures, set concrete will often not meet minimum strength requirements. This is especially true in warm weather climates (e.g., pours done in the summer).

Traditionally, this problem was overcome by cooling the water used in mixing the concrete or by adding ice as a partial replacement for the water. The water was cooled using a refrigeration unit, ice, or a cryogenic liquid which was mixed with the water before mixing the concrete. These methods are costly, time consuming and labor intensive. The extensive equipment and labor required for conventional approaches pose various safety concerns such as back injuries from lifting ice, loss of limbs from operating ice crushers, etc. Further, the use of ice can have a negative impact on the concretes characteristics, such as the slump measurement.

Another approach is to inject a cryogenic liquid directly into a concrete mixer drum of a truck while it is being mixed in a conventional rotating mixer. However, the injection processes used previously were cumbersome and expensive. Prior injection systems were stationary injectors, which required time-consuming structural adjustments in order meet the requirements of different size mixers. Further, the current injection systems are designed in a manner that increases the potential damage to the truck mixer drum.

Therefore, there is a need for an efficient and economically feasible apparatus and method for cooling concrete. There is a further need for an apparatus that is adjustable in order to quickly meet the requirements of the mixing chamber. There is a further need for a method and apparatus for operating the cooling system remotely.

SUMMARY

The present invention generally provides an apparatus and method for injecting fluid into a container. In one embodiment, the apparatus has a support structure with one or more leg assemblies and a lance support assembly pivotably coupled to the leg assembly and a lance. The lance is configured for reciprocating axial travel so that the lance has an extended and retracted position for fluid injection into the mixing container. The lance has a fluid path for flowing a cooling fluid therethrough, and an injection nozzle coupled to the fluid path, for injecting the cooling fluid into the container. In one embodiment the container is a concrete mixing container.

Another embodiment provides an apparatus for injecting fluid into a concrete mixing container. The apparatus has a lance configured for reciprocating axial travel so that the lance has a retracted position and an extended position for fluid injection into the concrete mixing container. The lance has a tube defining a fluid path for flowing a concrete cooling fluid therethrough. The tube is formed of a material suitable for transporting a cryogenic fluid through the fluid path. The lance also has an injection nozzle coupled to the fluid path. The cooling fluid is injected into the concrete mixing container through the injection nozzle. The apparatus also has a support structure for supporting the lance. The support structure is adjustable in at least one direction.

Another embodiment provides an injection system for injecting a cooling fluid into a mixture located in a container. The injection system has a tubular with an inlet nozzle and an outlet nozzle and defining a central fluid path fluidly coupled to the inlet nozzle and the outlet nozzle. The tubular is adapted for flowing the cooling fluid therethrough. The injection system also has a support carriage for supporting the tubular, the tubular being moveable longitudinally relative to the support carriage. The injection system further includes a support assembly for supporting the carriage, the support carriage being moveable relative to the support assembly. The injection system further includes a lifting mechanism having the support assembly pivotally attached thereto and configured to vertically actuate the support assembly. The injection system further includes one or more legs supporting the lifting mechanism. The injection system further includes a controller for actuating the tubular, the support carriage and the lifting mechanism. The controller is programmed with a cooling fluid injection sequence for causing the cooling fluid to be flowed through the central fluid path of the tubular and into contact with the mixture.

Another embodiment provides a method for cooling a concrete mixture. The method consists of providing an injection system. The injection system has a support structure, a lance and a fluid source. The lance has a fluid path and an injection nozzle fluidly coupled to the fluid path. The lance is movably disposed on the support structure and capable of movement relative to the support structure in at least one direction. The fluid source is fluidly coupled to the fluid path of the lance. The method further consists of adjusting a height of the lance relative to a concrete mixer. The method further consists of adjusting an alignment of the injection nozzle relative to an opening of the concrete mixer. Then extending the lance to insert at least the injection nozzle into the concrete mixer, and flowing a cooling fluid from the fluid source through the fluid path and out of the injection nozzle, whereby the cooling fluid is injected into the concrete mixer.

Another embodiment provides a method for cooling a concrete mixture. The method consists of providing an injection system. Then adjusting an orientation of the lance relative to a concrete mixer. Then extending the lance to insert at least the injection nozzle into the concrete mixer. The method further consists of initiating a concrete cooling process comprising flowing a cooling fluid from the fluid source through the fluid path and out of the injection nozzle, whereby the cooling fluid is injected into the concrete mixer. At least one characteristic of the concrete cooling process is monitored to detect an endpoint of the concrete cooling process. The method further includes retracting the lance from the concrete mixer upon detecting the endpoint. The injection system has a support structure, a lance and a fluid source. The lance has a fluid path and an injection nozzle fluidly coupled to the fluid path. The lance is movably disposed on the support structure and being capable of movement relative to the support structure in at least one direction. The fluid source is fluidly coupled to the fluid path of the lance.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF PREFERRED EMBODIMENTS

Figure 2:
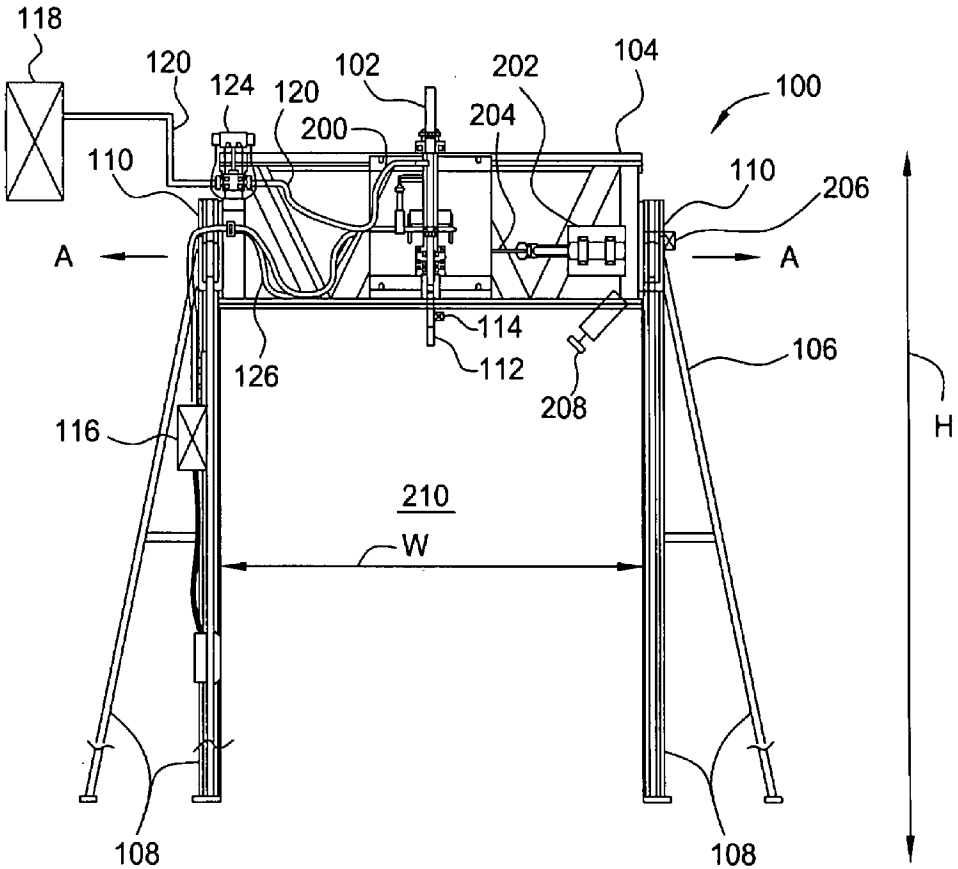
FIG. 2 is a front view of the injection system, according to one embodiment of the invention.
Figure 1:
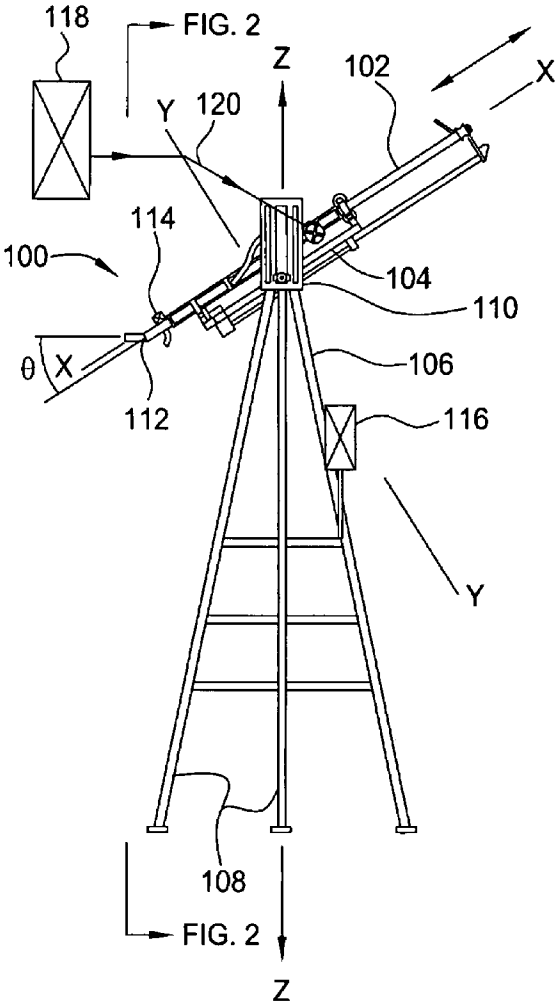
FIG. 1 is a side view of an embodiment of the injection system.

FIGS. 1 and 2 illustrate a side view and a front view, respectively, of an injection system 100, according to one embodiment of the invention. The injection system 100 includes a lance 102 configured to inject a fluid into a container (e.g., a concrete mixer 702, such as the one shown in FIG. 7). The lance 102 mounts to a carriage 200, shown in FIG. 2. The carriage 200 is disposed on a lance support assembly 104. The lance support assembly 104 is supported by a support structure 106. As shown, the support structure 106 consists of two sets of legs 108. Illustratively, there are three legs 108 for each support structure 106, however, it should be appreciated that any number of support legs 108 may be used. Further, there may be any number of support structures 106, including one leg. Further, as shown in FIG. 2, the two sets of legs 108 of the support structure 106 define an opening 210 having a height H and width W. In one embodiment, the size of the opening 210 is adjustable in at least one dimension (H and/or W).

FIG. 1 shows a fluid supply 118. Illustrativley, the fluid supply is remotely located, but in another embodiment, the fluid supply 118 is mounted to the injection system 100. The fluid source 118 is fluidly coupled to the injection system 100 with a fluid line 120 whereby a cooling fluid is supplied for injection into a container (not shown), via the lance 102. In one embodiment, the fluid source 118 can be turned on and off using a valve 124 attached to the lance support assembly 104, as shown in FIG. 2. Although the valve 124 is shown located on the lance support assembly it should be appreciated that the valve 124 can be located anywhere between the fluid source 118 and the lance 102 so long as the cooling fluid is supplied for injection into the container. In the illustrative embodiment, the lance 102 includes an outlet nozzle 112 for releasing the fluid. The outlet nozzle 112, as shown in FIG. 1, projects from the lance 102 at an angle Θ. In one embodiment the angle Θ is approximately a 45° angle substantially in the Y-Y plane. The angle Θ allows the cooling fluid to enter the container in a direction that prevents contact and damage to the container walls. Although the angle Θ is shown as a 45°, it should be appreciated that any angle or angular orientation relative to the lance 102 may be used. In one embodiment the nozzle is detachable to allow nozzles of different angles and sizes to be quickly attached as is appropriate for a particular application. In another embodiment, the angle Θ automatically adjusts to any angle and orientation relative to the lance 102, depending on the container requirements. In one embodiment, the lance 102 and nozzle 112 are metal (e.g. carbon steel, alloy). The cooling fluid may be any type known in the art such as liquid nitrogen, argon, oxygen, chilled water or carbon dioxide.

Thus, in one embodiment the lance 102 is a tubular that includes a central conduit defining the fluid path for the cooling fluid, and which is fluidly coupled to the nozzle 112. However, in another embodiment, the fluid path is disposed externally on the lance 102. For example, a fluid line may be secured to the outer surface of the lance 102 and feed into the nozzle 112. In this case, the lance 102 merely provides the requisite rigidity, but not the fluid path itself. In another embodiment, multiple fluid paths may be provided, and each fluid path may be fluidly coupled to its own injection nozzle (alternatively, each fluid path may feed into the same nozzle). The respective nozzles may each have a different angular orientation. In this case, it is further contemplated that each fluid path may be coupled to a different fluid source 118. Each fluid source may provide a respective fluid of a different type, temperature, flow rate, pressure, etc.

According to various embodiments of the present invention, the lance 102 is capable of movement with multiple degrees of freedom. The movement of the lance can be accomplished manually, electrically, with hydraulic pressure, or pneumatic pressure provided by lines 126 shown in FIG. 2. Further it should be appreciated that any combination of methods may be used to move the lance. This freedom of movement allows for easy adjustment of the lance 102 despite the angle, height and dimensions of the container (e.g., concrete mixer) relative to the injection system 100. For example, the lance 102 may be capable of axial movement along a X-X axis, rotational movement about a Y-Y axis and/or vertical movement along a Z-Z axis, all shown in FIG. 1. It is further contemplated that the lance 102 is configured for rotational movement about an A-A axis (the A-A axis being orthogonal to the Y-Y axis), shown in FIG. 2. Such axial and rotation freedom of movement may be achieved in any number of ways. Illustrative embodiments are described below. However, it is understood that the embodiments described herein regarding the movement of the lance 102 relative to other components of the injection system 100 are merely illustrative and other embodiments are within the scope of the invention.

For example, freedom of rotation about the Y-Y axis may be achieved by provision of a swivel connection (not shown) between the lance 102 and the carriage 200. The swivel connection allows the lance 102 to rotate about axis Y-Y as shown in FIG. 1.

Figure 3A:
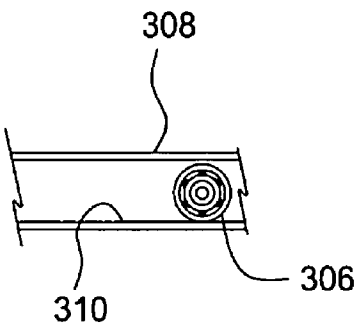
FIG. 3*a* is a side view of the roller bearing for attaching the carriage to the lance support, according to one embodiment of the invention.
Figure 3:
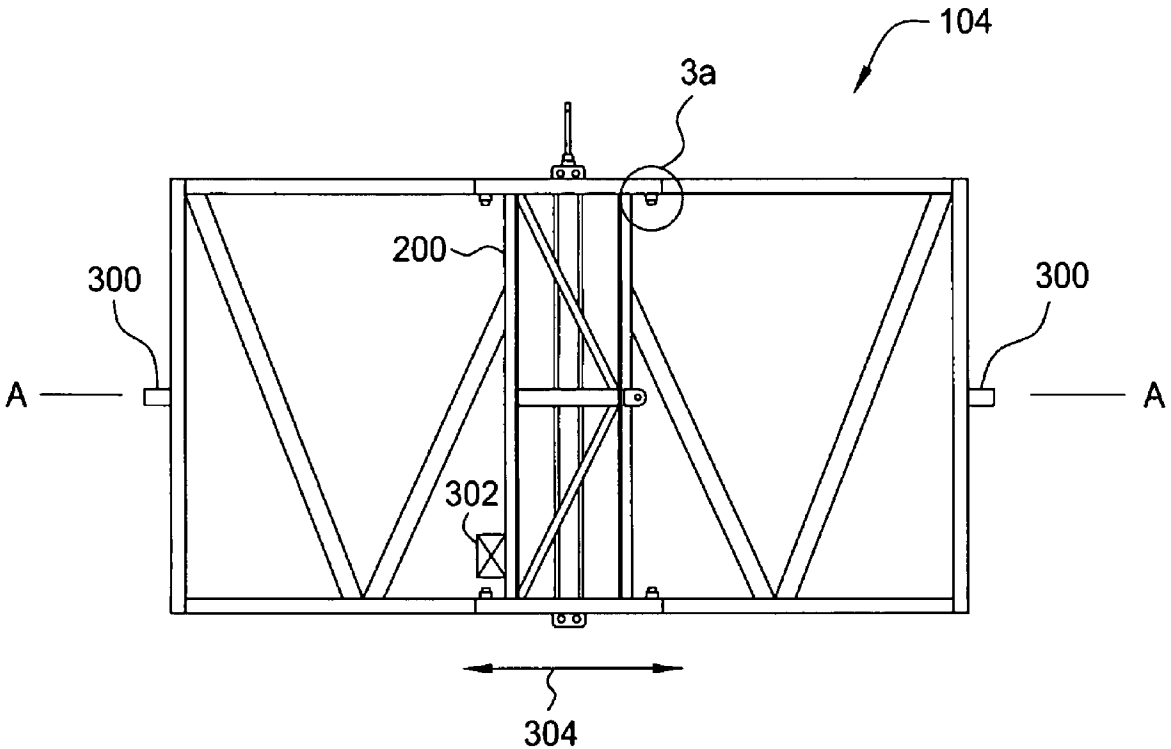
FIG. 3 is a top view of the support structure for the injector, according to one embodiment of the invention.

Rotation about the A-A axis may be achieved, for example, by pivotally attaching the lance support assembly 104 to the support structure 106 to allow rotation of the lance support assembly 104 about the axis A-A. Referring briefly to FIG. 3, a top view of the lance support assembly 104 is shown. Illustratively, the lance support assembly 104 includes a pair of support pins 300 formed on opposing sides of the lance support assembly 104. Referring again to FIG. 2, the pins 300 are received by openings (not shown) formed in a vertical lift system 110. Accordingly, the lance support assembly 104 is pivotally suspended between the two sets of legs 108 of the support structure 106, whereby the entire lance support assembly 104 is freely rotatable to any angle desired by an operator using automation or by manual operation. In one embodiment, a motor 206 (shown schematically) rotates lance support assembly 104. The motor 206 fixedly attaches to the support structure 106, while a drive shaft (not shown) connects to the pin 300. The drive shaft then transfers rotation directly to the lance support assembly 104 via the pin 300. In one embodiment, the motor 206 is a servo motor but, more generally, may be any kind of motor capable of providing the desired rotational actuation of the lance support assembly 104. In another embodiment, a hydraulic or pneumatic actuator (not shown) could be used, or any other actuator known in the art. By operating the motor 206, the angle of the lance support assembly 104 is adjusted and thus adjusts the angle of the lance 102 which is attached to the lance support assembly 104. In this manner, the lance 102 can be positioned to enter a compartment (e.g., a concrete mixer) at a desired angle, e.g., so as not to come into contact with the side walls of the compartment. Although shown as pivoting about pins 300, it should be appreciated that the lance support assembly 104 could be stationary with the lance 102 being adapted to pivot separately relative to the lance support assembly 104. In yet another embodiment, both the lance 102 and lance support assembly 104 could be rotatably mounted, thereby allowing the lance 102 and lance support assembly 104 to be adjusted relative to each other as well as to the rest of the injection system 100.

In one embodiment, the carriage 200 is movably disposed on the lance support assembly 104 so that the carriage 200 is moveable in (or parallel to) a plane defined by the lance support assembly 104. Referring again to FIG. 3, the carriage 200 is shown slidably mounted to the lance support assembly 104 on one or more roller bearings 306 (detail shown in FIG. 3*a*). Illustratively, four roller bearings 306 are shown. Each roller bearing 306 is disposed in, and travels on, a track 310 formed on an inner surface a guide rail 308 of the lance support assembly 104. Bidirectional lateral movement (illustrated by the arrow 304) of the carriage 200 is thus achieved. In one embodiment, the carriage 200 is actuated by an actuator 202, shown in FIG. 2. Illustratively, the actuator 202 is a piston-type actuator mounted to the lance support assembly 104 and coupled to the carriage 200 by a piston rod 204. In the alternative, it is contemplated that a drive device, such as a motor 302 (shown in FIG. 3) connected to the roller bearing 306, a mechanical arm, or an operator could control the carriage 200. Thus, as the carriage 200 moves along the lance support assembly 104, the lance 102 moves with the carriage 200 so that the lance 102 aligns with the mixer 702.

Figure 4:
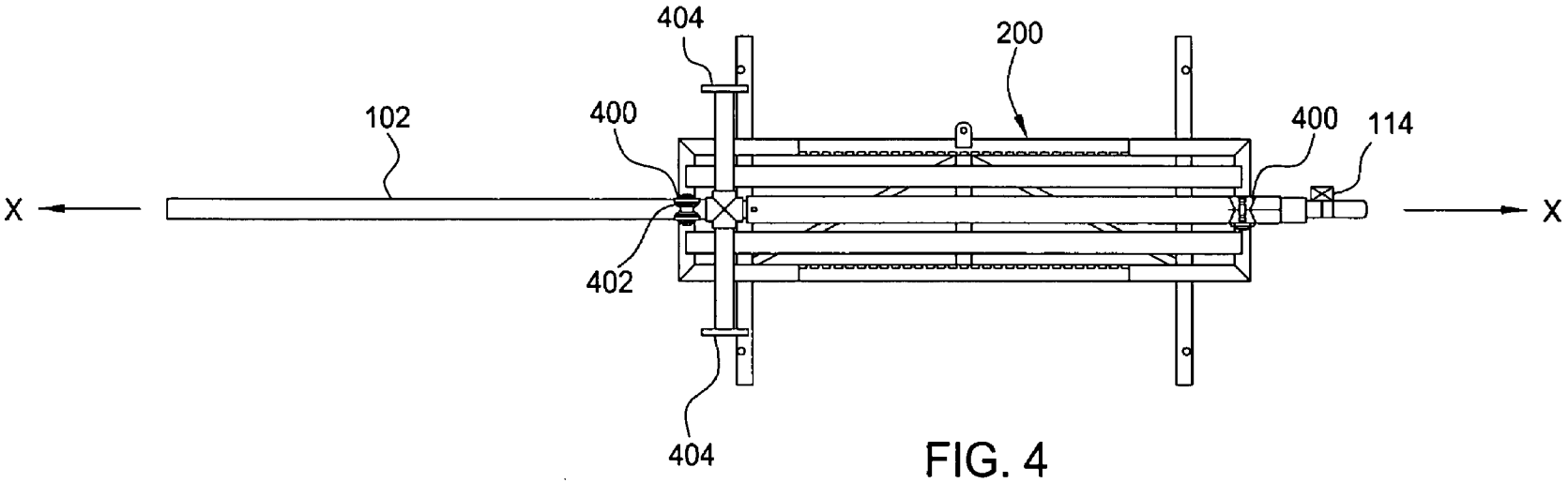
FIG. 4 is a top view of the injector, according to one embodiment of the invention.
Figure 5:
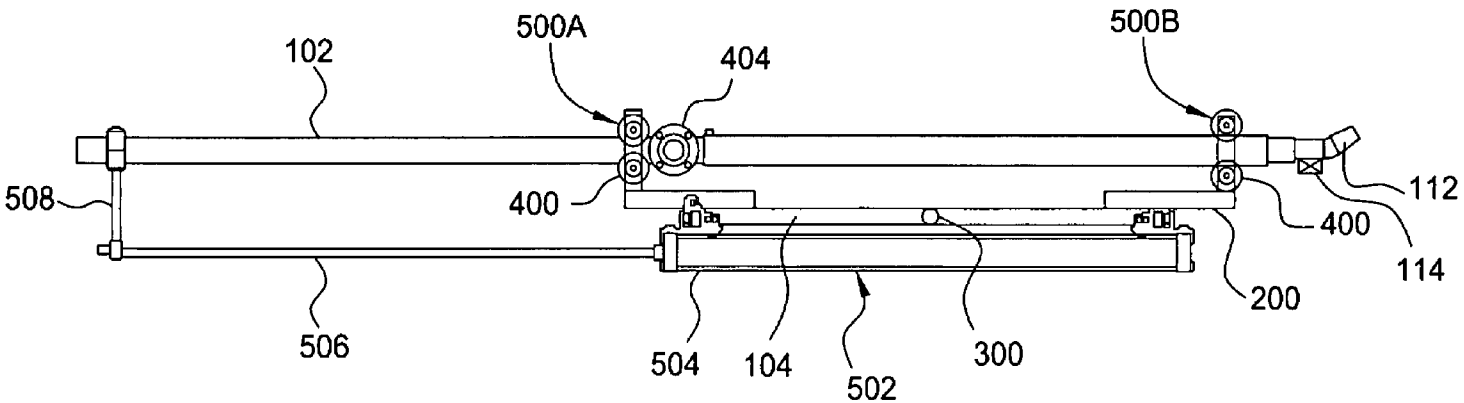
FIG. 5 is a side view of the injector, according to one embodiment of the invention.
Figure 9:
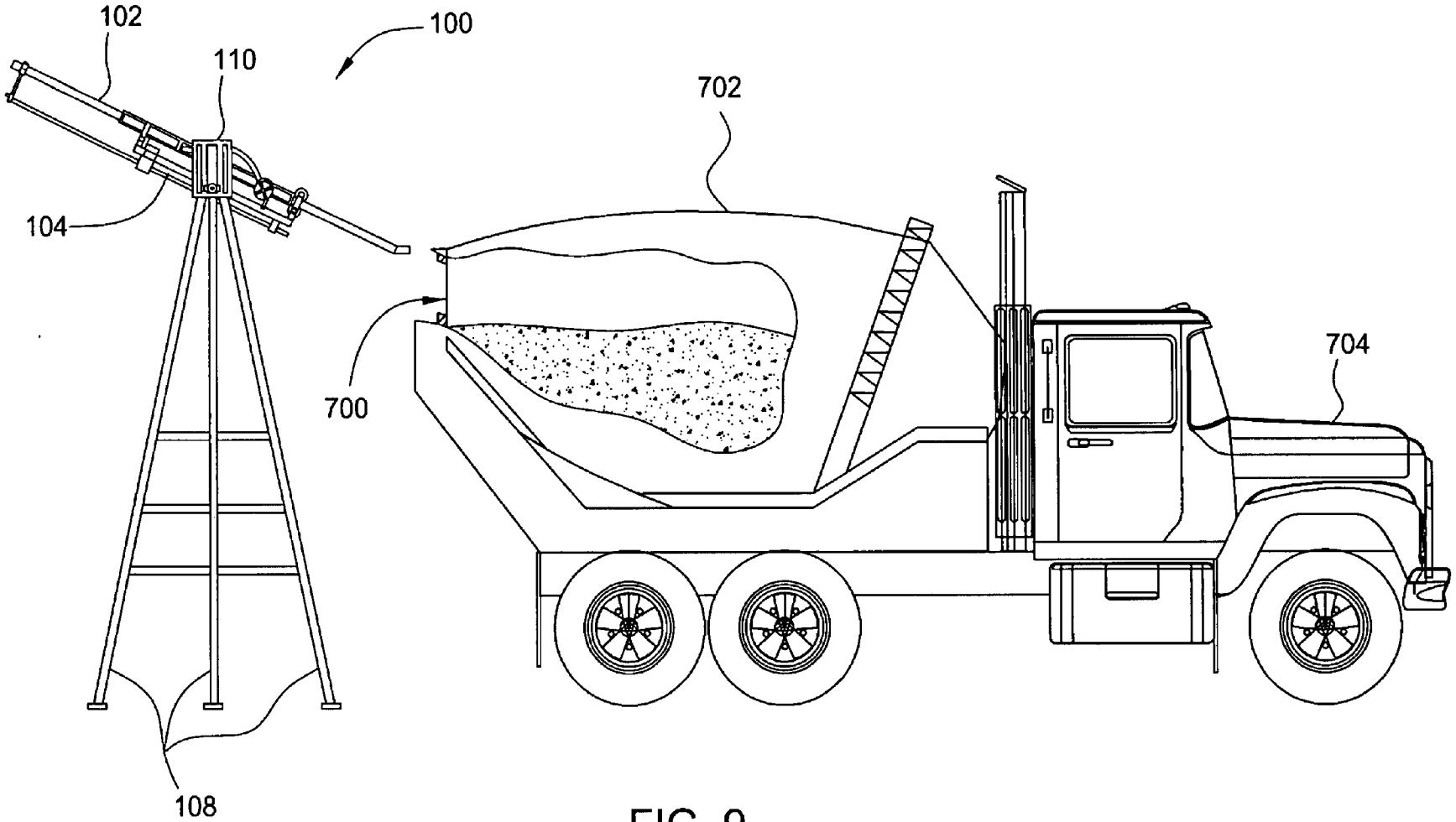
FIG. 9 is a cross sectional view of the mixer and injection system with the injection system deactivated, according to one embodiment of the invention.
Figure 10:
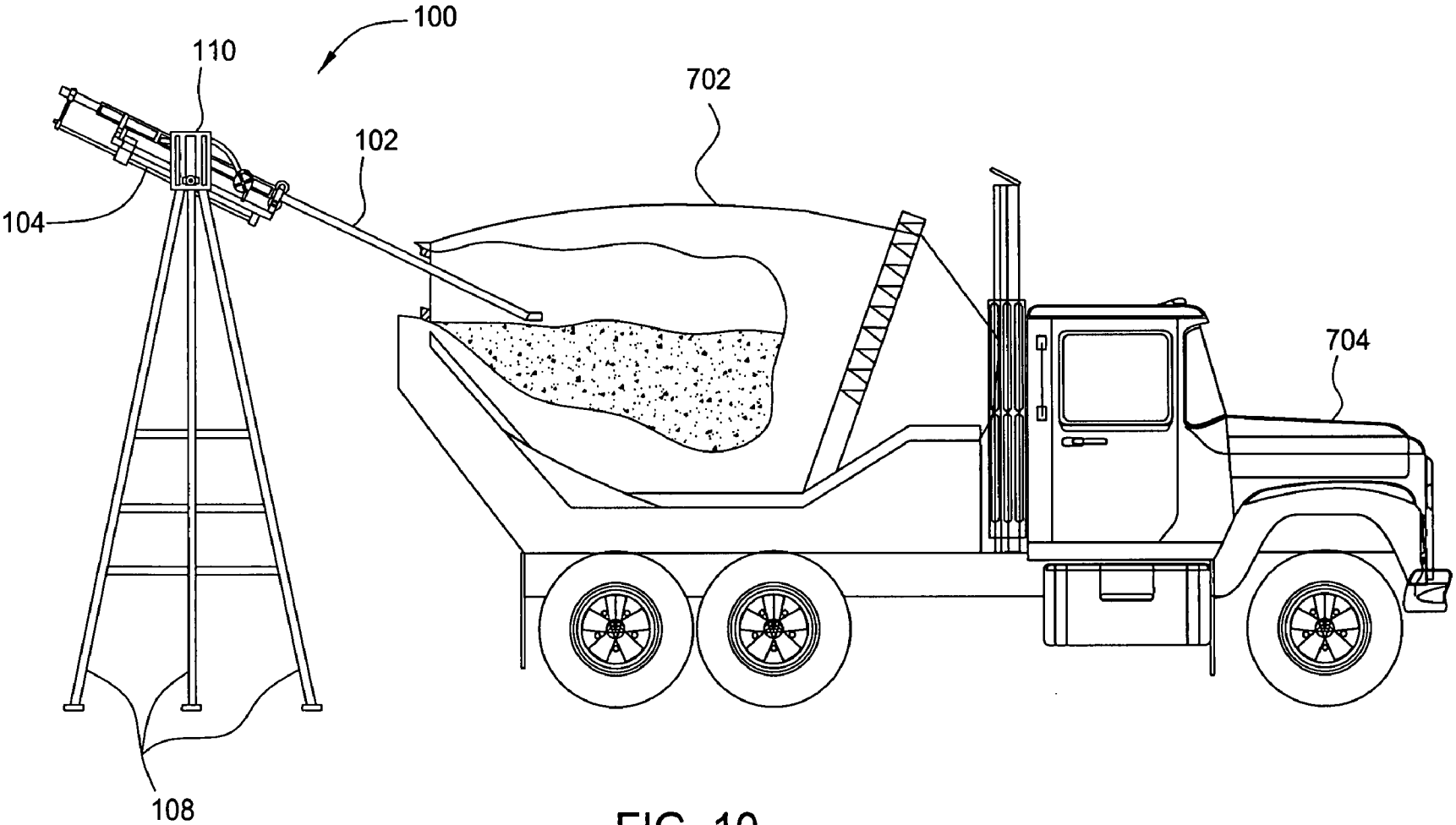
FIG. 10 is a cross sectional view of the mixer and injection system with the injection system activated and inside the mixer, according to one embodiment of the invention.

As was stated above, it is also contemplated that the lance 102 moves along its own axis, X-X, as shown in FIG. 1. Accordingly, the lance 102 has a retracted position and an extended position (as shown in FIGS. 9 and 10, both of which will be described in more detail below). To this end, the lance 102 slidably extends through a pair of roller guides 500A-B, as shown in FIG. 5 (showing a side view of the injector). In one embodiment, each roller guide 500A-B includes a pair of rollers 400 arranged in-line relative to each other. The rollers 400 of each pair define an opening through which the lance 102 extends. In one embodiment, one or more of the rollers 400 include a groove 402 (one shown in FIG. 4) sized to receive a least a portion of the lance 102. In such an arrangement, the guides 500A-B at once stabilize the axial orientation of the lance and allow the lance 102 to travel axially along the X-X axis. The rollers 400 mount to the carriage 200, for supporting the lance 102. In one embodiment the upper roller of rollers 400 is detachable. Thus, if the truck moves before the lance 102 is retracted the upper roller will detach allowing the lance 102 to move, ensuring the lance 102, the truck or the injection system 100 is not damaged.

In the illustrative embodiment, the axial motivation of the lance 102 is achieved by the provision of an actuator assembly mounted to the carriage 200 and coupled to the lance 102. Referring now to FIG. 5, a side view of an actuator 502 is shown according to one embodiment. The actuator assembly 502 includes a piston cylinder 504 fixedly attached to the support carriage 200 and a moveable piston rod 506. The piston rod 506 is connected at one end to the lance 102 by a coupler 508. In one embodiment, the coupler 508 is secured to the piston rod 506 and the lance 102 by fasteners such as screws, thereby allowing the coupler 508 to be readily adjusted at a desired length of the piston rod 506 and/or the lance 102. In operation, the piston cylinder 504 reciprocally drives the piston rod 506 axially, thereby moving the lance 102 along its axis X-X. Although the lance is shown mounted on rollers 400 with a piston assembly attached to axially move the lance, it should be appreciated that any method of axially extending the lance 102 may be used. For example, a telescoping lance, a rack and pinion system, or motorized rollers are all contemplated as alternative embodiments. Combinations of such embodiments are also contemplated. For example, the lance may include both the roller guides permitting the slidable axial movement, in addition to a telescoping feature Also shown in FIG. 5 is an inlet nozzle 404 for connecting to the fluid source 118. The inlet nozzle 404 provides an opening into the fluid path formed in the lance 102, and which ultimately terminates at the nozzle 112. Preferably, the inlet nozzle is fitted with a quick disconnect fitting, whereby the fluid line from the fluid source 118 may be quickly attached and detached. The inlet nozzle 404 may include more than one inlet nozzle to increase accessibility in multiple direction. For example, inlet nozzles 404 could be on either side of the lance 102, as shown in FIG. 4.

In one embodiment, the support structure 106 includes a vertical lift system 110 which connects the support structure 106 to the lance support assembly 104. The vertical lift system 110 allows the lance support assembly 104 to be raised or lowered, along the Z-Z axis (FIGS. 6A and 6B).

Figure 6A:
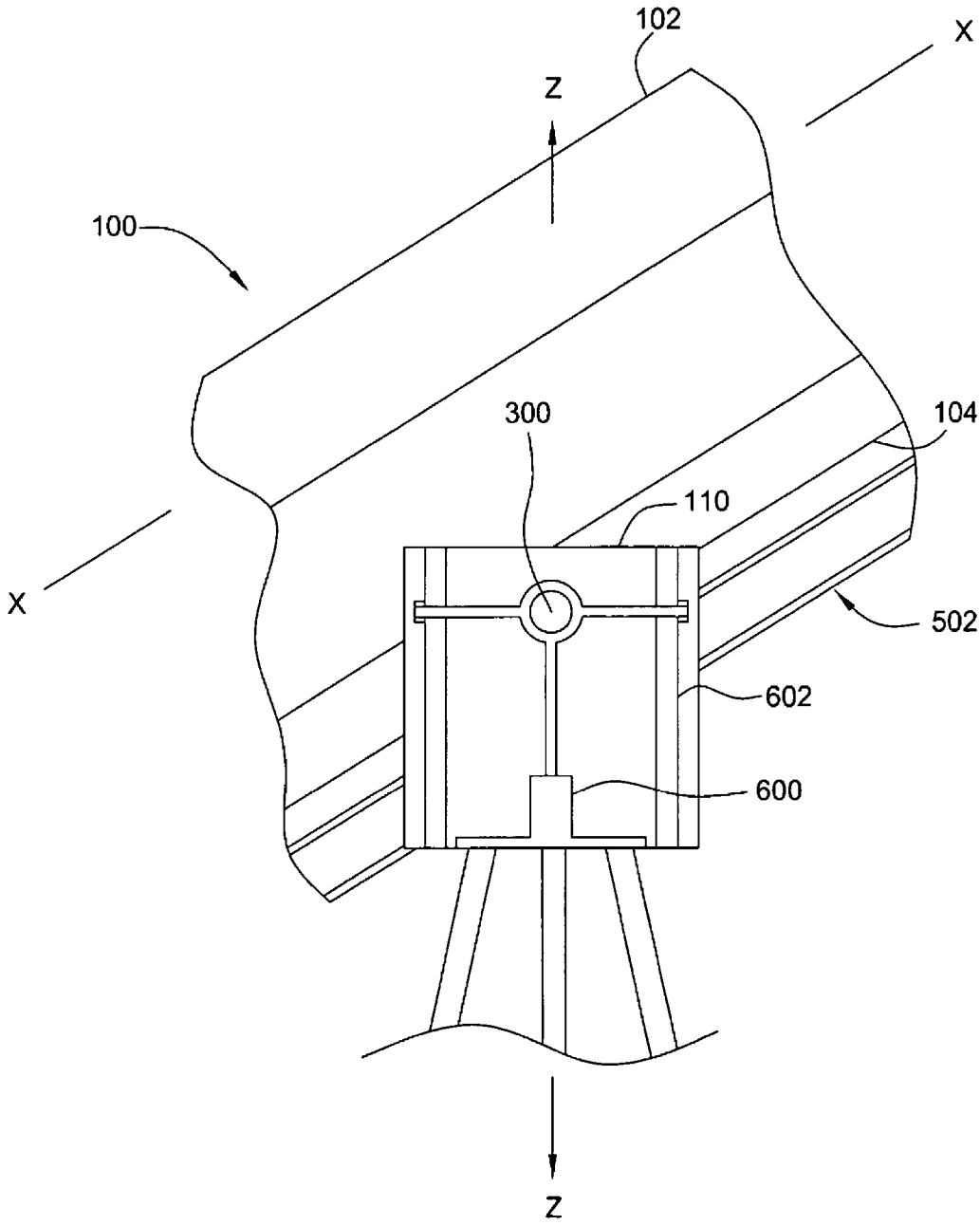
FIGS. 6A and 6B are a side view of a vertical lift system, according to one embodiment of the invention.
Figure 6B:
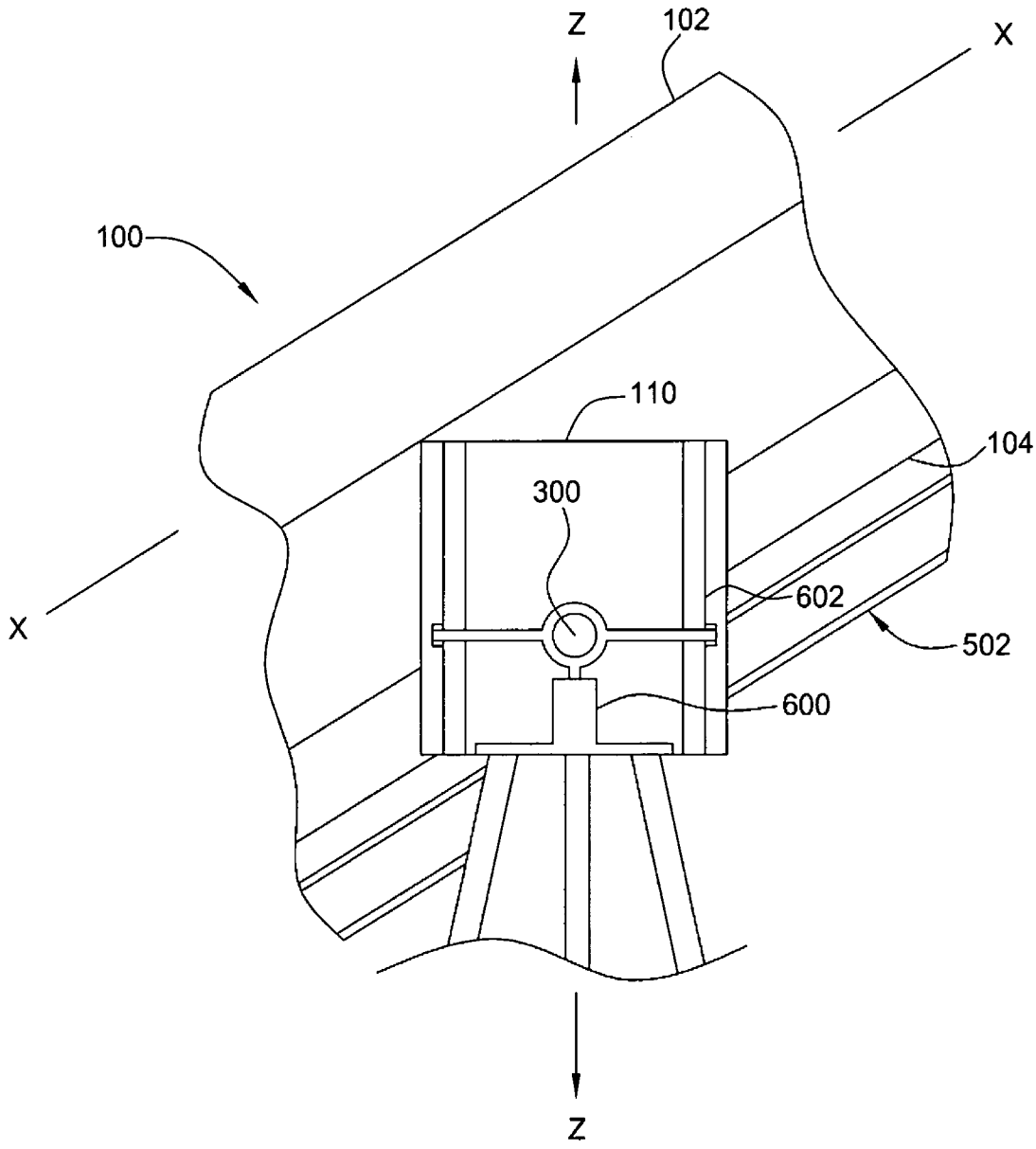

FIGS. 6A and 6B show the vertical lift system 110 in more detail. The vertical lift system 110 includes one or more lifting pistons 600 coupled to the pins 300. The vertical lift system 110 may also be equipped with one or more guide rails 602 for stability. Although shown as a piston lift assembly, any mechanism for lifting the lance support assembly 104 could be used. For example, in another embodiment a worm drive is used as the actuation mechanism.

Figure 8A:
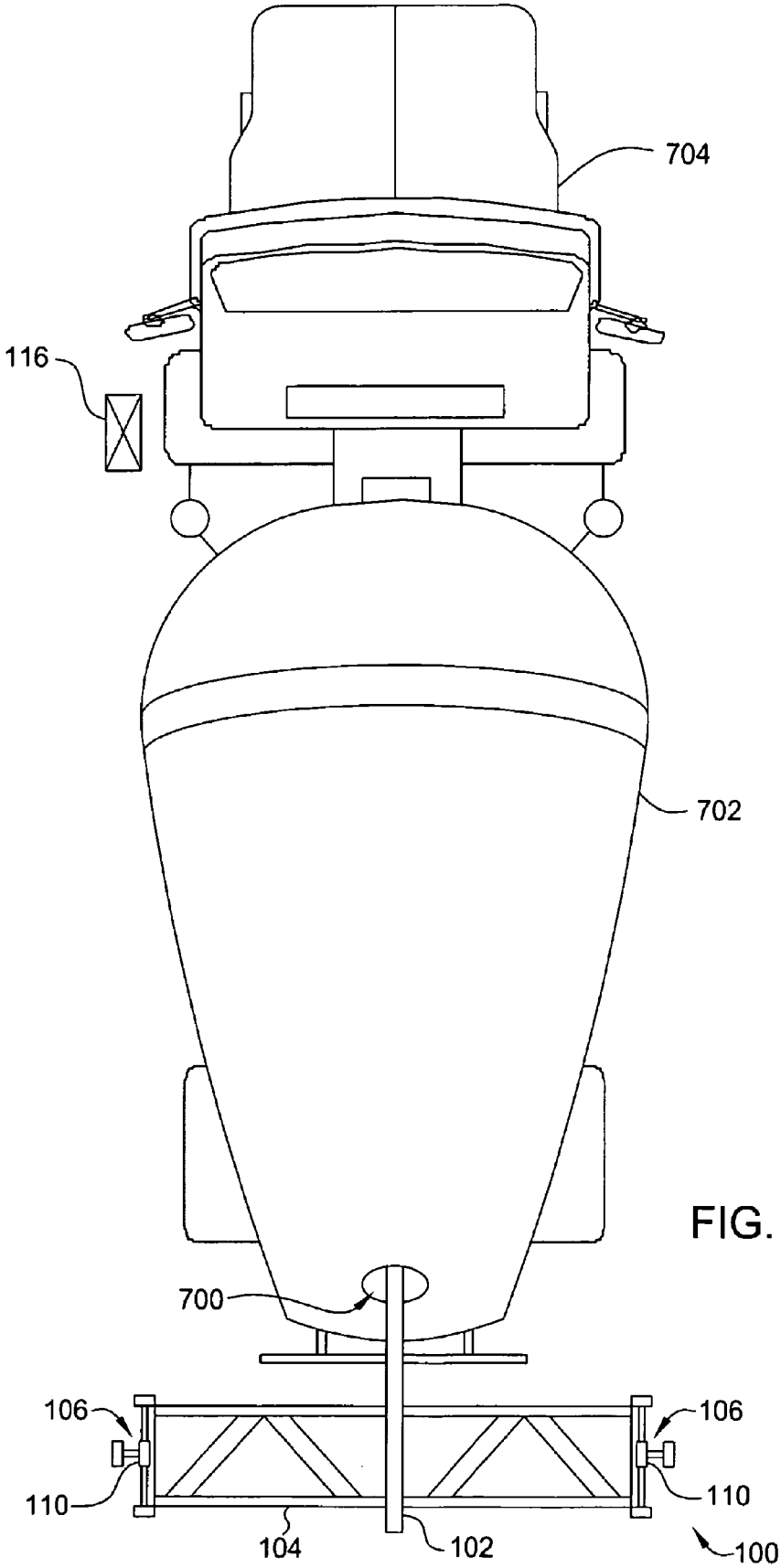
FIG. 8A is a top view of the mixer with the injections system, according to one embodiment of the invention.
Figure 8B:
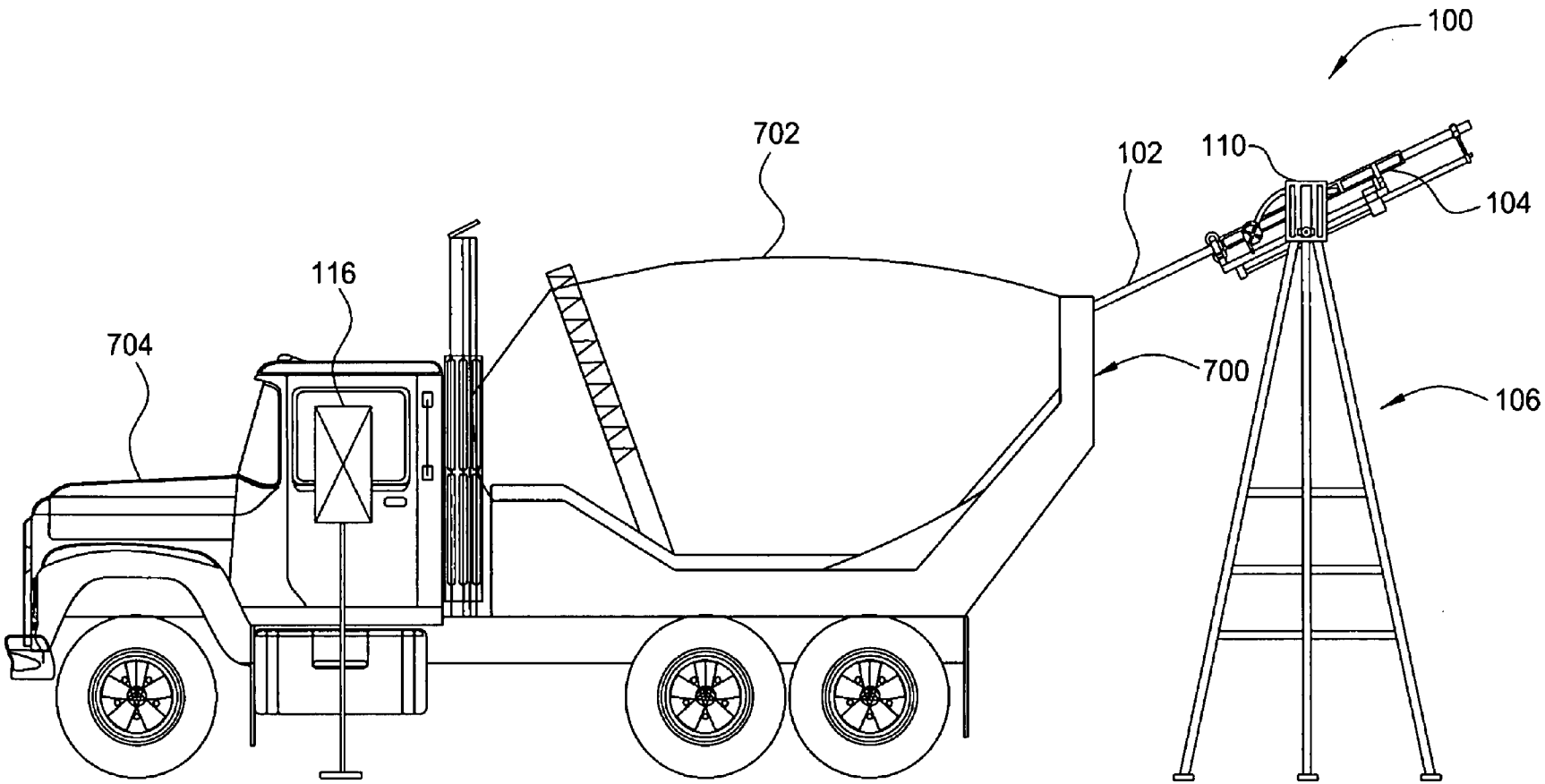
FIG. 8B is a side view of the mixer with the injections system, according to one embodiment of the invention.

Operation of the injection system 100 is generally contemplated by manual means, automated means or a combination thereof. In one embodiment, a controller is communicatively coupled to the one or more actuators disposed on the injection system 100. In a particular embodiment, a controller is mounted to the injection system 100. For example, FIGS. 1 and 2 show a controller 116 (shown schematically) mounted to the support structure 106; although it also contemplated that the controller 116 may be remotely located from the injection system 100. For example, FIGS. 8A and 8B show a top and side view of the injection system 100, the controller 116 and a truck 704, in which the controller 116 is remotely located from the injection system 100. Preferably, the controller 116 is positioned to allow a driver of the truck 704 to reach out of window of the truck cab and input commands to the controller 116, while still being close enough to the injection system 100 to allow the lance 102 to enter the mixer 702 and inject a cooling fluid, as will be described in more detail below. In one embodiment, the controller 116 is a handheld device that is in wireless (e.g. infrared, RF, Bluetooth, etc.) communication with the injection system 100. The handheld device can be operated from any location including the cab of the truck 704.

Figure 11:
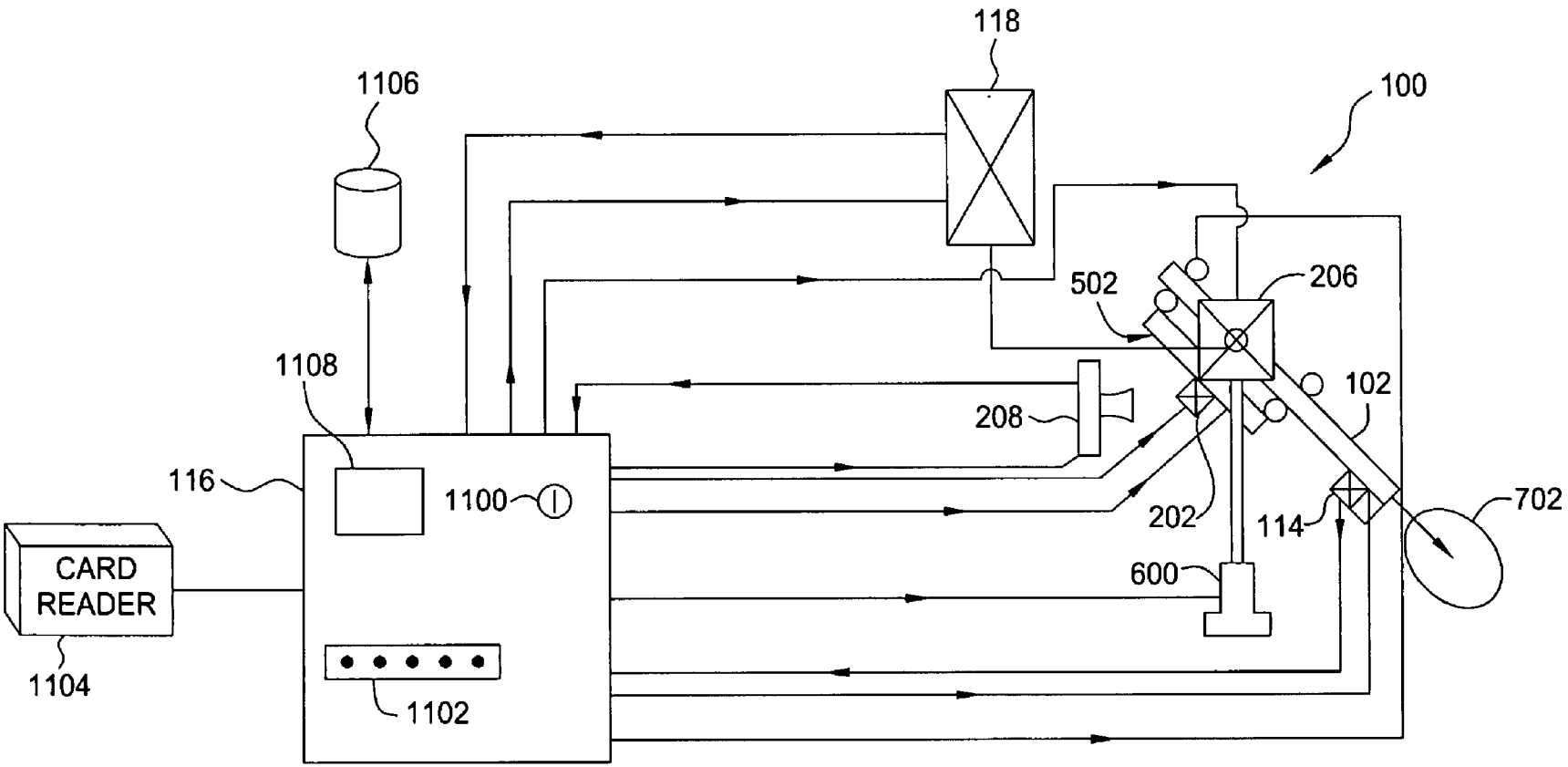
FIG. 11 is a schematic of a controller, the injection system and a fluid source, according to one embodiment of the invention.

Referring now to FIG. 11, a schematic is shown of the controller 116 and various components connected to the controller 116. In various embodiments, the controller 116 can be in wireless (e.g., infrared, RF, Bluetooth, etc.) or wired communication with components of the injection system 100. Illustratively, the controller 116 is communicatively coupled to the support carriage actuator 202, the lance support assembly actuator 206, the lance actuator 502, the lifting pistons 600, the fluid source 118, a sensor 114, and a camera 208. The controller 116 may generally be configured to operate each of the respective components in an automated fashion (e.g., according to a preprogrammed sequence stored in memory) or according to explicit user input.

Although not shown, the controller 116 may be equipped with a programmable central processing unit, a memory, a mass storage device, and well-known support circuits such as power supplies, clocks, cache, input/output circuits and the like. Illustratively, the controller 116 also includes a key-operated locking mechanism 1100 which may be used to enable the injection system 100. Once enabled, an operator may control the operation of the injection system by inputting commands into the controller 116. To this end, one embodiment of the controller 116 includes a control panel 1102. The control panel 1102 may include a key pad, switches, knobs, a touch pad, etc. In one embodiment, the operator is required to input a pass code into the control panel 1102 in order to operate the injection system 100. The controller 116 may also include, or be connected to, a card reader 1104. The data read from a card by the card reader 1104 can be used to determine whether the card holder is an authorized operator. Accordingly, the controller 116 may have a network connection to a database 1106 accessed to verify the authorization of the card holder by comparing information read from the card to information stored in the database. In one embodiment, the controller 116 has a wireless receiver (e.g., RF receiver) which can detect a signal of a wireless transmitter associated with a particular operator. On the basis of the wireless signal, the controller can determine whether the particular operator is an authorized user. Accordingly, any number of authentication and access control devices are contemplated. The controller 116 may also be configured to track various information related to the use of the injection system 100. Accordingly, operator identity and other usage information (e.g., time and date, quantity of cooling fluid, temperatures, etc.) can be tracked. The controller 116 shown in FIG. 11 also includes an output device 1108 (e.g., a display and/or a speaker). The output device 1108 may provide information to the operator including, e.g., information regarding the progress of the current injection cycle.

In operation, the controller 116 issues commands to one or more components of the injection system 100 and, in some cases, receives feedback from the components. In particular, the controller 116 issues control signals to the various actuators to orient the lance 102 at a desired location while positioning the lance 102 into a container 702. Once the lance 102 is positioned, the controller 116 issues a command to open an appropriate valve of the fluid source 118, whereby fluid is allowed to flow from the fluid source 118 and ultimately out of the injection nozzle 112.

In one embodiment, the controller 116 is further communicatively coupled to sensing equipment configured to facilitate inserting the lance 102 into the container 702. Illustrative sensing equipment shown in FIG. 11 includes the sensor 114 and the camera 208. Although shown as a singular unit, the sensor 114 may be representative of any number of sensors. The sensor 114 may be any type of sensing device or system configured to detect proximity of the container 702. Illustrative sensors include acoustic sensors and optical (e.g., laser) sensors. During operation of the injection system 100, the sensor 114 detects a relative distance/location of the container 702 and provides the detected distance/location information to the controller 116. The controller 116 then responds by making appropriate adjustments to the orientation of the lance 102 (e.g., by issuing signals to one or more of the actuators) during continued extension of the lance into the container 702. In this way, the controller 116 and the sensor 114 define a closed loop feedback system configured to ensure that the lance 102 avoids contacting the container 702 and terminates at a desired location within the container 702. Alternatively, or in addition (to the sensor 114), the camera 208 may be provided to capture and transmit a picture (via, e.g., video feed) to the output device 1108. The operator of the injection system 100 may then observe the operation of the lance 102 via the output device 1108.

In one embodiment, the controller 116 is further communicatively coupled to temperature sensing equipment, also represented by the sensor 114. The temperature sensor 114 could be any type contemplated in the art, such as a contact type or contactless device. In general, a contact type element could be inside or outside the concrete mixer. The contact type temperature probe could be a temperature measuring element in contact with the outer surface of the drum to take skin temperature readings. Illustrative contact elements include thermocouples and thermistors. Regardless of the type of contact element, it may be constructed such that contact is maintained during rotation of the drum, i.e. by being spring loaded or using a brush type probe having sufficient flexibility to adapt to the outer surface of the drum as it rotates. It is also contemplated that the contact element may be in direct contact with the concrete mixture. An example of a contactless temperature measuring device is an infrared sensor. Infrared measuring devices are well-known and are capable of measuring an object's (e.g., concrete mixture) temperature from a distance. The infrared sensor may be mounted on the injection system 100 (e.g., on the lance) in a manner that the infrared light can be projected into the mixture in order to take a temperature reading of the concrete mixture. In one embodiment, the infrared measuring device may include a laser sight to facilitate aiming the infrared light a desired spot. In operation, the temperature sensor 114 measures the temperature of the mixture (e.g., concrete mixture) contained in the container 702 during a mixing operation. If the mixer 702 or the concrete mix were to become too cold, the controller 116 shuts down the injection system 100. In one embodiment, the operator first inputs a desired temperature (temperature setpoint) of the mixture to be cooled, before the cooling fluid injection begins. Once the temperature setpoint is reached, the controller 116 may issue a command to stop the flow of liquid nitrogen and retract the lance 102 from the container 702. It is also contemplated that the temperature of the fluid being flowed through the lance 102 is measured.

Figure 7A:
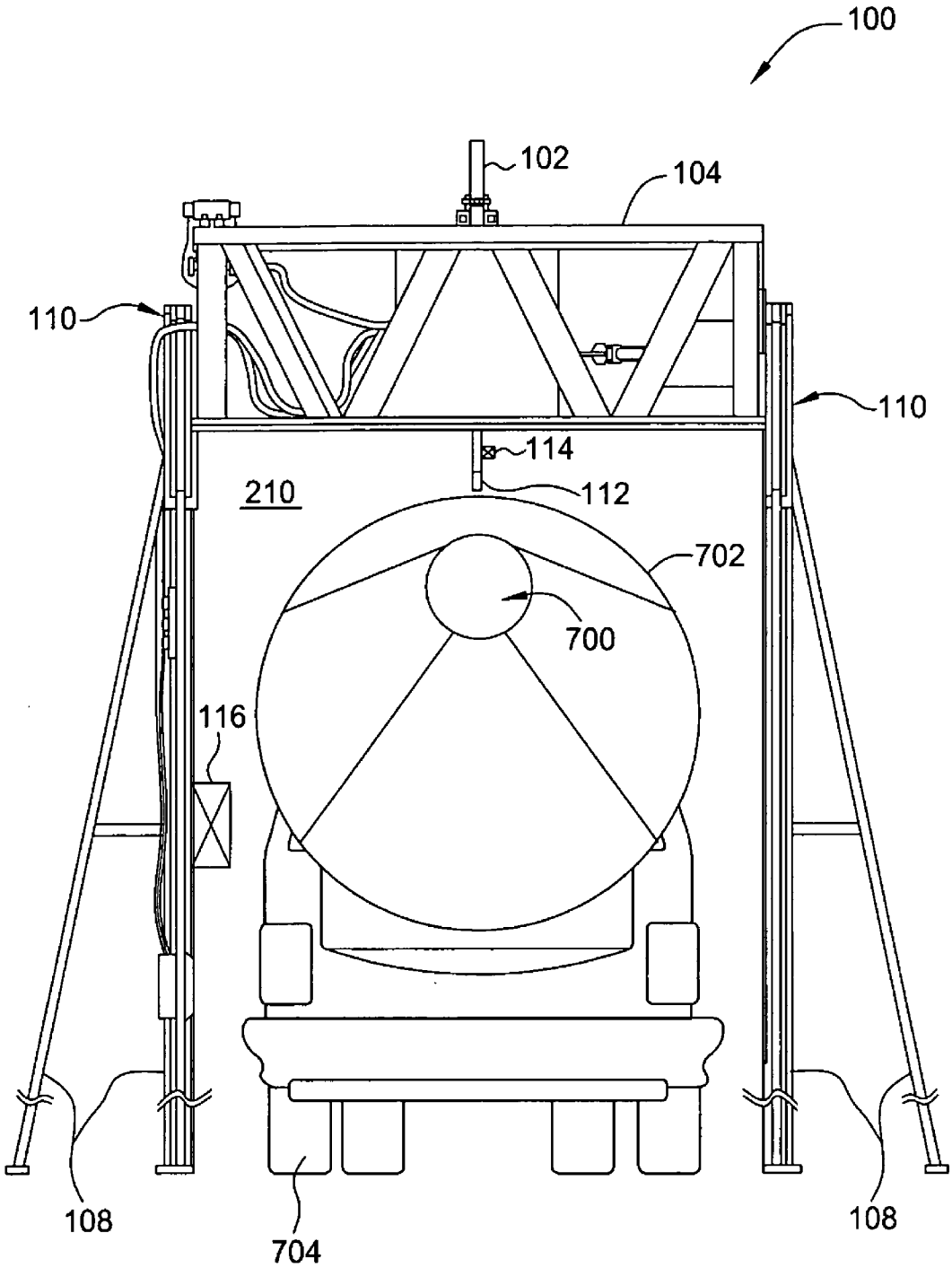
FIGS. 7A and 7B are a back view of the mixer with the injections system, according to one embodiment of the invention.

Additional details of the operation of the injection system 100 will now be described with reference to FIGS. 7-11. Referring first to FIG. 7A, a rearview of the injection system 100 and a cement mixing truck 704 is shown. FIG. 7A shows the injection system 100 in a standby position in which the injection system 100 is raised to a height providing sufficient clearance for the truck 704 to drive through the opening 210 formed by the legs 108 and the lance support assembly 104 of the injection system 100. The truck 704 then proceeds to drive through the opening 210 of the injection system 100 until the truck 704 is at a desired position with respect to the injection system 100. More particularly, the desired position is defined by a relative distance of the injection nozzle 112 and the opening 700 of the mixer 702. Such a distance may be any distance from which the lance 102 can be sufficiently extended into the mixer 702. In one embodiment, the driver of the truck 704 may be instructed to halt the truck 704 (at the desired position) by receiving an appropriate signal from the controller 116. The controller 116 may issue the signal upon detecting (by signals received from the sensor 114) that the desired position has been reached. Alternatively, the driver may use the image received from the camera 208 to determine when the desired position has been reached. In another embodiment, the truck 704 is equipped with a computer chip and communication system (not shown) that sends the controller 116 the dimensions and location of the truck 704. Thus, as the truck 704 reaches the proper location the controller will actuate and insert the lance 102 into the mixer 702 automatically.

Figure 7B:
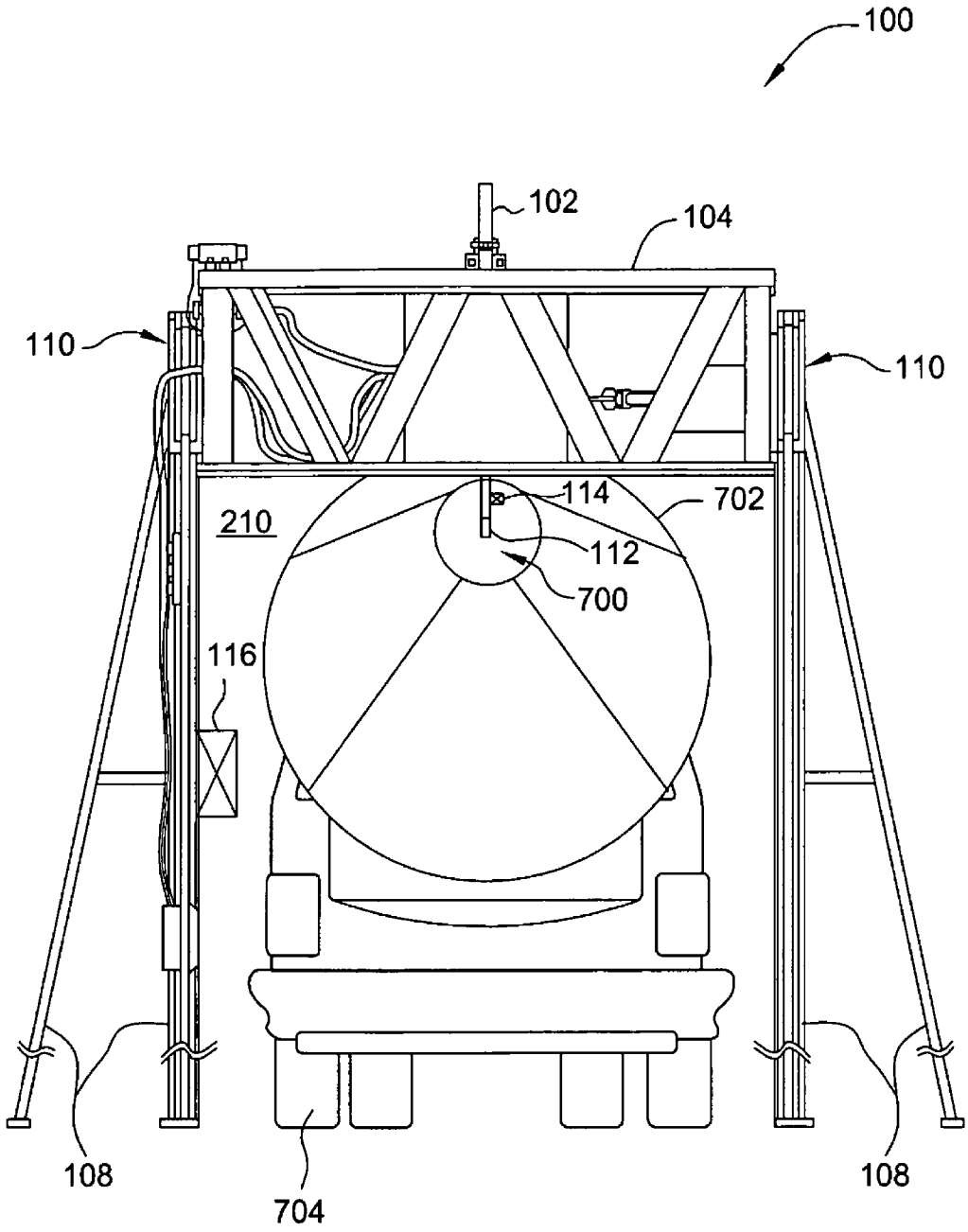

In any case, once the desired position has been reached, the vertical lift system 110 is actuated to lower the lance support assembly 104 to a penetration height, as shown in FIG. 7B. A side view of the truck 704 (cutaway view shown) and the injection system 100 at the penetration height is shown in FIG. 9. The controller 116 then issues a command (e.g., either according to a preprogrammed sequence or user input) causing the lance 102 to be extended into the mixer, as seen in FIG. 10. In a fully automated environment, the controller 116 issues the lance extension command upon detecting that the truck 704 is properly positioned. During its extension, the lance 102 may be guided by appropriate control signals issued by the controller 116 in order to prevent the lance from contacting the mixer 702, as described above. Thus, insertion of the lance 102 into the mixer 702 is possible regardless of the size and position of the mixer aperture 700. Further, the lance 102 is capable of entering the mixer 702 while the mixer is turning or when it is stationary. Additionally, the driver of the truck is afforded greater tolerance in maneuvering the truck 101 into a desired position.

Once the lance 102 is properly positioned in the mixer 702, the controller 116 issues a command causing the cryogenic fluid to be injected into the concrete mix in the mixer 702. Once the concrete mix is cooled to the desired temperature the controller 116 issues a signal to stop the injection of the fluid. The controller 116 then issues a signal to retract the lance 102 from the mixer 702. The operator is then free to move the truck 704, or pour the concrete. It is contemplated that for each of the steps in the operation of the injection system 100, the controller 116 provides output to the operator. In this way, the operator is made aware of which step of the injection process is currently being performed. For example, when the injection is completed, the controller 116 may sound an audible signal (which may be a recorded human voice announcing completion of the process).

The foregoing sequence of operation is merely illustrative and persons skilled in the art will recognize other embodiments within the scope of the invention. For example, instead of driving through the opening 210, a truck may back up into the desired position. Further, instead of inserting the lance 102 into the mixer aperture 700, the mixer 702 may include a separate opening for receiving the lance 102 or the injection nozzle 112.

During a concrete pour the injection system 100 may be brought to the site of the pour. Accordingly, it is contemplated that the injection system 100 is portable. To this end, the injection system 100 can adapted to be an integral part of a truck or a trailer (not shown) so that it is easily transported to the pour location. Transportation and setup may be further facilitated by configuring the injection system 100 to be easily assembled and disassembled. For example, the injection system 100 may be modularized as a base portion (e.g., the support assembly 106) and a mounted/suspended portion (e.g., the lance support assembly 104 and carriage 200). Additionally, or alternatively, portions of the injection system 100 may be collapsible (e.g., folding or telescopic). Additionally, or alternatively, the injection system 100 may be fitted with quick-disconnect fittings for the coupling to the fluid supply 118. Thus, the fluid supply may be transported separately and once a fluid supply is consumed, the empty fluid supply 118 may be quickly disconnected and a new fluid supply may be quickly connected to the injection 100.

Figure 12:
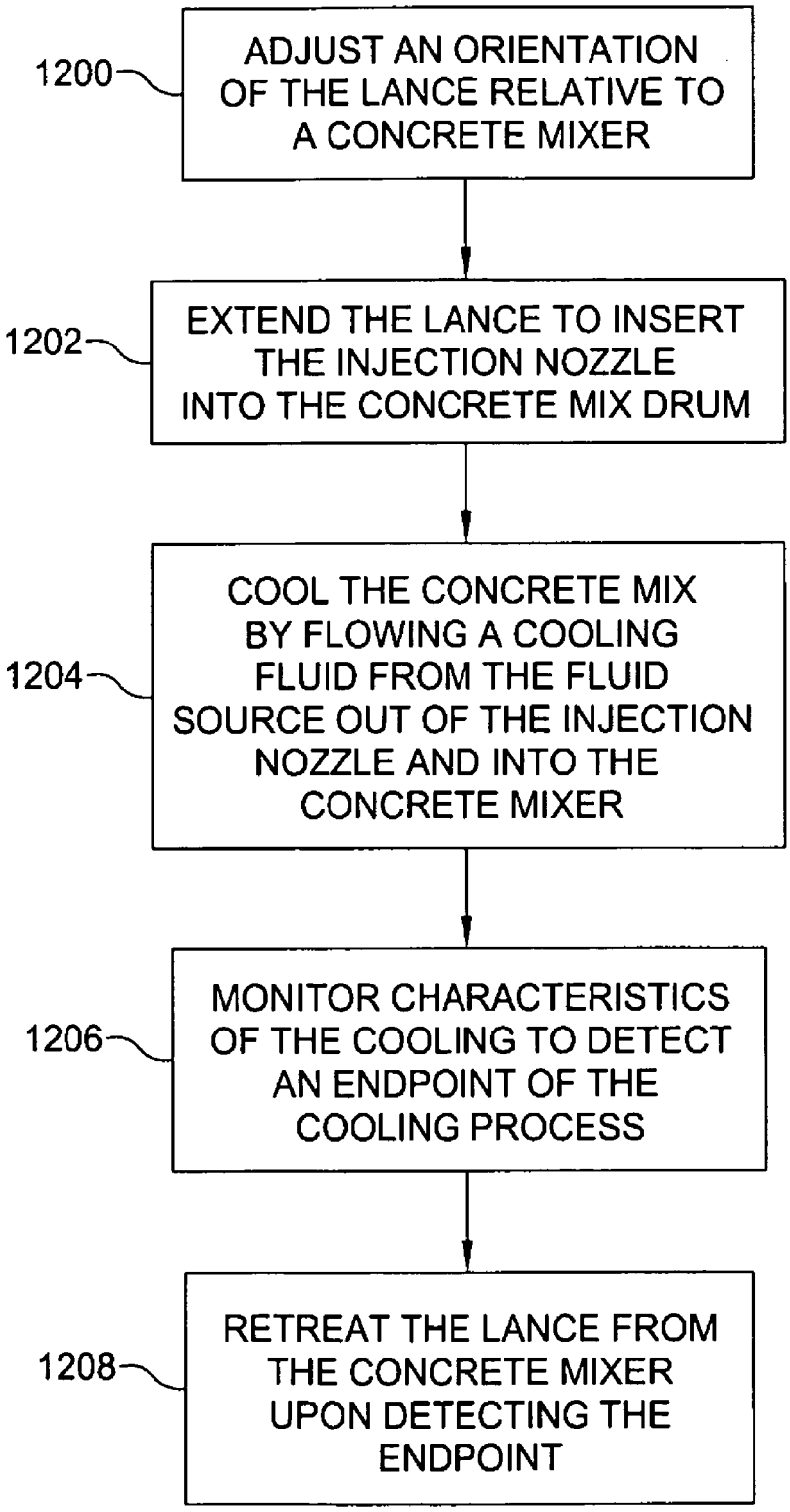
FIG. 12 is a flow chart, according to one embodiment of the invention.

FIG. 12 depicts a flow chart of steps of the cooling process according to one embodiment of the present invention. The first step 1200 an orientation of the lance 102 adjusts relative to the concrete mixer 702. In the second step 1202, the lance 102 extends to insert the injection nozzle 112 into the concrete mixer 702. In the third step 1204, the concrete mix cools by flowing a cooling fluid from the fluid source 118 out of the injection nozzle and into the concrete mixer. The fourth step 1206 monitors the characteristics of the cooling to detect an endpoint of the cooling process. In the fifth step 1208 the lance retracts from the concrete mixer upon detecting the end point.

In other embodiments it is contemplated that the injection system is used to inject water, food and beverage products, hydrocarbon products, gravel, sand, other minerals, or any other products contemplated by one of skill in the art.

It will be understood that many additional changes in the details, materials, steps, and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

What is claimed is:

1. A method for cooling a concrete mixture, said method comprising:

a) providing a concrete mixer having disposed therein a concrete mixture that is to be mixed and poured, said concrete mixer being in the form of a concrete truck;

b) providing an automated injection system that is independent of the concrete truck, comprising:

i) a support structure that comprises a leg assembly having at least two legs and a lance support assembly pivotally suspended between the two legs to define an opening sufficient to allow for the concrete truck to drive beneath the lance support assembly and between the at least two legs of the leg assembly;

ii) a lance comprising a fluid path and an injection nozzle fluidly coupled to the fluid path; the lance being movably disposed on the lance support assembly of the support structure and the lance support assembly being capable of movement relative to the leg assembly of the support structure in at least one direction; and iii) a fluid source fluidly coupled to the fluid path of the lance;

c) moving the concrete truck comprising the cement mixer between the at least two legs and beneath the lance support assembly, d) adjusting a height of the lance relative to the concrete mixer by issuing a command signal from a controller;

e) adjusting an alignment of the injection nozzle relative to an opening of the concrete mixer by issuing a command signal from a controller, said adjusting comprising pivoting the lance support assembly to achieve a desired angular orientation of the lance relative to the opening of the concrete mixer;

f) extending the lance to insert at least the injection nozzle into the concrete mixer; and g) flowing a cooling fluid from the fluid source through the fluid path and out of the injection nozzle, whereby the cooling fluid is injected into the concrete mixer and allowed to mix with the concrete mixture.

2. The method of claim 1, wherein adjusting the height comprises issuing a command signal from a controller to a lifting mechanism coupled to the support structure.

3. The method of claim 1, wherein adjusting the alignment comprises at least one of adjusting an angular orientation of the lance and adjusting a lateral orientation of the lance.

4. The method of claim 1, wherein adjusting the alignment occurs during the extension of the lance.

5. The method of claim 1, wherein adjusting the height comprises increasing the height of the opening defined by the lance support assembly and the at least two legs of the leg assembly to accommodate the concrete truck.

6. The method of claim 1, wherein the command signal from the controller for adjusting the height and adjusting the alignment is issued from a cab of the concrete truck.

7. The method of claim 1, wherein the command signal from the controller for adjusting the height and adjusting the alignment is issued from a controller being activated automatically upon the mixer being located at a predefined proximity to the injection system.

8. The method of claim 1, wherein the method further comprises monitoring the temperature of the concrete cooling process by utilizing a laser temperature sensor to detect an endpoint of the injection of a cooling fluid in the concrete cooling process by detecting a desired temperature of either the concrete mixture, the outer surface of the concrete mixer or both.

9. A method for cooling a concrete mixture, said method comprising:

a) providing a concrete mixer having disposed therein a concrete mixture that is to be mixed and poured;

b) providing an automated injection system that is independent of the concrete mixer, comprising:

i) a support structure that comprises a leg assembly having at least two legs and a lance support assembly pivotally suspended between the two legs;

ii) a lance comprising a fluid path and an injection nozzle fluidly coupled to the fluid path; the lance being movably disposed on the lance support assembly of the support structure and the lance support assembly being capable of movement relative to leg assembly of the support structure in at least one direction; and iii) a fluid source fluidly coupled to the fluid path of the lance;

c) moving the concrete truck comprising the cement mixer between the at least two legs and beneath the lance support assembly, d) adjusting an orientation of the lance relative to the concrete mixer by issuing one or more command signals from a controller;

e) extending the lance to insert at least the injection nozzle into the concrete mixer;

f) initiating a concrete cooling process comprising flowing a cooling fluid from the fluid source through the fluid path and out of the injection nozzle, whereby the cooling fluid is injected into the concrete mixer and allowed to mix with the concrete mixture;

g) monitoring at least one characteristic of the concrete cooling process to detect an endpoint of the concrete cooling process; and h) retracting the lance from the concrete mixer upon detecting the endpoint.

10. The method of claim 9, further including sensing the conditions of concrete mix.

11. The method of claim 9, wherein the monitoring comprises sensing a temperature of the concrete mixture.

12. The method of claim 11, wherein sensing the temperature is done with a laser temperature sensor mounted to the lance.

13. The method of claim 9, wherein detecting the endpoint of the injection of cooling fluid in the concrete cooling process comprises detecting a desired temperature of the concrete mixture or the surface of the concrete mixer or both.

14. The method of claim 9, wherein adjusting the orientation of the lance comprises:

i) detecting a relative position of the lance and the opening using sensing equipment; and ii) responsively moving the lance into a desired position relative to the opening.

* * * * *